United States Patent [19]

Gordon et al.

[11] Patent Number: 4,941,799

[45] Date of Patent: Jul. 17, 1990

[54] DISPLACEABLE SUPPORT FOR WHEELCHAIR

[75] Inventors: George W. Gordon, Allentown; Theodore F. Economy, Orefield, both of Pa.

[73] Assignee: Gordecon, Inc., Catasauqua, Pa.

[21] Appl. No.: 246,972

[22] Filed: Sep. 20, 1988

[51] Int. Cl.[5] ..... A61G 7/00

[52] U.S. Cl. ..... 414/678; 414/921; 414/639; 254/124; 297/DIG. 4

[58] Field of Search ..... 297/310, DIG. 10, 347, 297/345, 339, DIG. 4; 414/921, 678, 640, 608, 628, 639, 662; 254/3 R, 3 B, 3 C, 124; 248/421

[56] References Cited

U.S. PATENT DOCUMENTS 3,476,404 11/1969 Rachman ..... 297/DIG. 4 X
4,527,944 7/1985 Qually et al. ..... 414/921 X
4,669,943 6/1987 Zamotin ..... 414/921 X
4,685,608 8/1987 McFarland ..... 414/921 X

*Primary Examiner*—David A. Bucci
*Assistant Examiner*—James Eller
*Attorney, Agent, or Firm*—Steele, Gould & Fried

[57] ABSTRACT

A height and tilt adjustable wheelchair support has a stationary base (30) with a main support leg (38) thereon. A platform (50) receives a wheelchair (20) and the platform (50) is connected to the main support leg (38) via a chassis (70), vertically movable via a length extendable cylinder (78) connected between the base (30) and the chassis (70). A second length-adjustable cylinder (88) rotates the wheelchair supporting platform (50) relative to the chassis (70) around a pivot (92) such that the wheelchair (20) can be raised, lowered, or tilted, via independent controls.

14 Claims, 5 Drawing Sheets

DISPLACEABLE SUPPORT FOR WHEELCHAIR

BACKGROUND OF THE INVENTION

1. Field of the Invention

This invention relates to the field of adjustably-positionable supports for persons, for example of the type used by dentists to position a patient at a convenient height and inclination, and in particular to such a support wherein the patient is supported in the first instance by a wheelchair, the wheelchair being engaged by the adjustably-positionable apparatus.

2. Prior Art

Person-supporting chairs used by dentists, hairdressers and the like are well known. By electric, pneumatic or hydraulic actuating means, normally controlled by means of foot switches or the like, the dentist, dental auxiliary or other user positions the patient at an attitude most comfortable and convenient for a particular procedure to be undertaken. Dentists and dental auxiliaries normally tilt the back of the patient's chair backwards to a relatively low angle, and then raise the patient to within convenient reach.

It has been necessary heretofore in connection with patients occupying wheelchairs to move the patient out of the wheelchair and into the dentist's chair, whereupon the patient would be treated in the usual manner. This procedure can be difficult, and in order to accommodate moving patients in and out of wheelchairs and the like, various complicated and expensive suspension devices have been developed. These devices are moderately dangerous for the patient, who is vulnerable to injury if dropped or jerked about.

The present invention avoids any need to transfer a patient from the safety of the wheelchair to similar safety in the dentist's chair. The invention retains benefits equal to or greater than the dentist's chair, such as the adjustability benefits of a typical dentists' chair. The patient and wheelchair are together wheeled onto an adjustable support mechanism engaging the wheelchair and having tilt means and, preferably, vertical positioning means. This allows the patient to be wheeled onto the device, then lifted and tilted as required in order to position the patient's oral area at the correct inclination and height, but using the mobility of the wheelchair for moving the patient into place.

Wheelchair lifts are known in connection with public transportation equipment, elevators to traverse stairs and the like. In these cases, the wheelchair is wheeled onto a movable platform which can be hydraulically or electrically raised and lowered to allow the wheelchair to be wheeled on at one level and wheeled off at another. It is normally considered dangerous to allow a wheelchair-supporting device to tilt, due to the danger that the wheelchair will roll off the tilting support or that the chair will fall over. According to the invention, the wheelchair is engaged by the device, for example rolled to the back of an L-shaped support, which is then tilted to retain the wheelchair against the L, safely and securely. Due to engagement of the chair it is not readily possible to remove the chair from the device once the device is moved out of its lower-most up-right position.

In positioning an item which must be raised and also tilted, and is as large and irregularly weighted as a person in a wheelchair, substantial stability problems are encountered. When an item such as a wheelchair is positioned at a tilt and is raised high above its supporting base, relative movements, for example caused when making small corrections in position, frequently cause the support structure to wobble. This wobbling is very disturbing to the dentist as well as the patient and if resonance is involved, the wobbling can even upset the support. The present invention concerns independent height and tilt adjusting mechanisms, and when raised to the maximum and tilted, the structural arrangement, in particular the linkage driving the degree of tilt, has a varying lever arm whereby the greatest relative motion of the support structure per unit of drive motion (i.e. the minimum mechanical advantage of the drive) is achieved when the device is in its lower-most up-right stable position, and the maximum mechanical advantage (i.e., the minimum lever arm and therefore the least possibility of wobbling and lurching) is encountered at the maximum tilt.

Control of the raising/lowering and tilting functions of the invention are preferably independent for greatest versatility. Limit switches are provided to cut power to the length-extendable devices, preferably electric linear actuators, when full deflection of the actuators is reached. The limit switch technique is also used for other control functions, for example to preclude operation of the chair until the wheelchair rests against the back of its support.

The invention concerns a device especially useful in connection with institutions where a substantial number of inmates use wheelchairs. Instead of having to transport successive patients in either direction between their wheelchairs and a supportive (dentist's) chair, a user (dentist) at such an institution can simply wheel the patient into position engaging the support mechanism and otherwise proceed in a conventional manner. The "user" is not limited to a dentist or dental auxiliary, but also includes hairdressers, barbers and the like. The invention is also applicable to ophthamology, optometry, podiatry and other medical fields.

SUMMARY OF THE INVENTION

It is an object of the invention to achieve the benefits of a controllably-positionable chair for a wheelchair.

It is another object of the invention to facilitate convenient medical (especially dental) procedures as well as personal grooming procedures for persons in wheelchairs, without a major effort to move such persons about.

It is a further object of the invention to provide a wheelchair position-and-lift support having safety features precluding the wheelchair from inadvertently being removed from the support or upset when on the support, and also including comfort features avoiding wobbling and lurching notwithstanding the cantilevered weight of the wheelchair and patient.

These and other objects are accomplished by a wheelchair support including a stationary base, a chassis carried on the base, a wheelchair engaging means such as a platform supported at least partly on the chassis, the platform receiving and supporting the wheelchair, and, a controllable angular extension mechanism disposed on the chassis, the angular extension mechanism being operable to rotate the wheelchair engaging means around an axis adjacent the chassis. Preferably, a vertical extension mechanism operable independently of the angular extension mechanism is connected by one end to the base and by a second end to the chassis, whereby the chassis and the wheelchair can be raised and lowered, and the wheelchair can be tilted as required to safely and conveniently position a wheelchair occupant, who remains in the safety of his or her wheelchair throughout.

BRIEF DESCRIPTION OF THE DRAWINGS

There are shown in the drawings the embodiments that are presently preferred. It should be understood, however, that the invention is not limited to the precise arrangements and instrumentalities shown in the drawings, and in accordance with the appended claims is capable of embodiment in various other forms and in other groupings and subcombinations of the disclosed features. In the drawings.

DETAILED DESCRIPTION OF THE PREFERRED EMBODIMENTS

Figure 1:
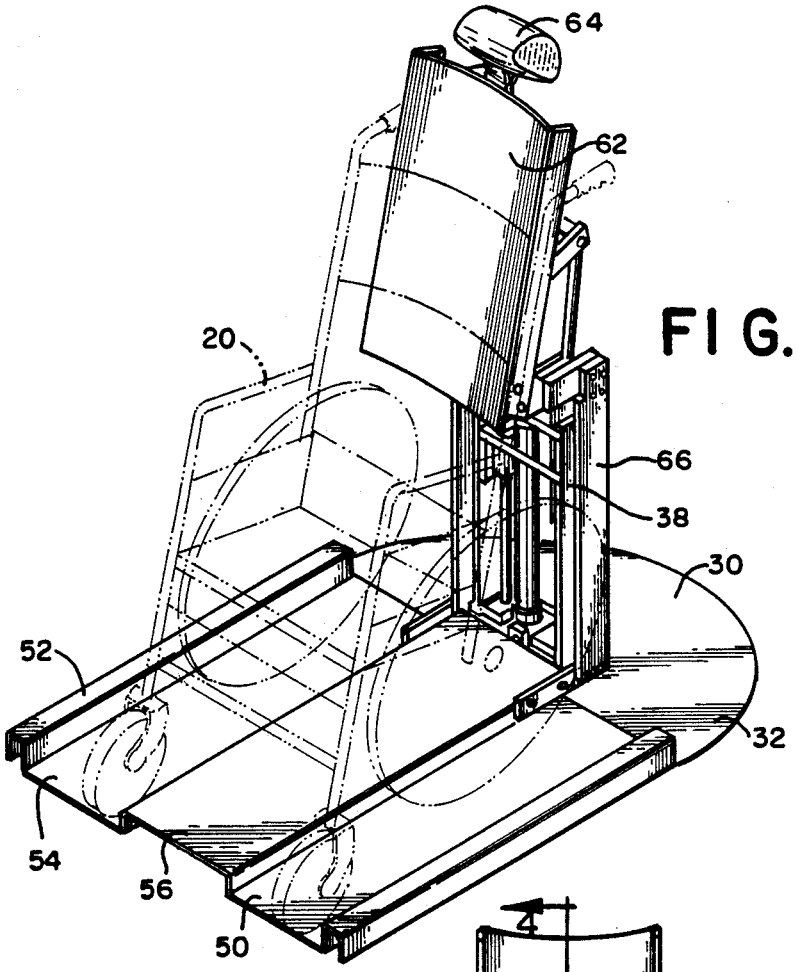
FIG. 1 is a perspective view of the invention, a wheelchair thereon being shown in phantom.

To use the present invention, a wheelchair 20 is rolled into position and temporarily fixed to a movable wheelchair-engaging structure such as platform 50, shown in FIG. 1, platform 50 being carried on a movable chassis 70. The fixed wheelchair is adjusted for tilt and preferably also for height, by means of extendable drive cylinders attached to the chassis. Vertical positioning of the chassis is driven by a first drive cylinder 78, attached between the chassis and a base. The particular structure rigidly attached to movable platform 50 is mounted on a pivotable linkage driven by a second drive cylinder 88, connected between the chassis and a point spaced from the pivot axis. The second cylinder is operable to tilt the wheelchair 20 about the pivot axis, located near the top of the vertically movable chassis structure 70. Thus the wheelchair is simply wheeled up to the device with the patient aboard. When engaged thereon such as by being wheeled onto the platform 50, the patient can be raised, lowered and tilted, in the same manner as an ambulatory patient using a more conventional dentist's chair.

The invention preferably uses both height and tilt adjusting means for positioning the patient. It is also possible to use the invention for the patient a tilt adjustment only; and to have a height adjustment mechanism on the support for the dentist or other operative rather than the patients. In that case the dentist can have a height-adjustable stool and the patient is either not lifted or lifted only slightly to facilitate tilting movements. The invention will be described with respect to a preferred embodiment in which both height and tilt are controlled.

The overall support and positioning structure is carried on a stationary base plate 30, having side wings 32 extending to either side and a front tab 34 extending forward under movable platform 50, in particular under the downwardly-opening channel section 56 of platform 50. The base plate thus extends outwardly in each direction from the central column in which the lift and tilt mechanisms are disposed. The base plate structure is shown clear of the movable platform 50 in FIG. 3. The base plate structure is wide enough to accommodate shifting weights carried on the movable platform device, keeping the center of gravity of the load well within the space defined by stationary plate 30. Plate 30 can be bolted to the floor, but this is not strictly necessary. Leveling pads can be included to ensure a stable support.

Carried on stationary plate 30 is at least one main support leg 38, preferably two such support legs, spaced from one another and providing a stable vertical supporting structure. A vertical height adjusting means, for example drive cylinder 78 is provided for driving upward and downward a movable chassis element. Cylinder 78 is attached at its lower end to a fitting 46, and at its upper end to a cross member 76, closely associated with a shaft defining the horizontal pivot axis around which the movable support structure is rotatable.

The chassis element includes cross member 76, chassis base plate 68, and a pair of side bars 72, together forming a rectangular configuration, the uppermost member of which carries the pivot axis for tilting. The chassis slides up and down relative to main support legs 38, on slide shafts or bars 72. Bars 72 are slidably received in linear bearing elements 42, attached to the inside surfaces of the two main support legs 38, which stand upright on base 30. Preferably, the linear support bearings 42 are positioned such that the chassis base plate 68, at full vertical extension, abuts the lowermost one of the linear bearings 42. Bearings 42 are also spaced somewhat, providing better stability and less wear on sliding shafts 72.

A number of the components of the device can be made of aluminum for decreased weight. Slide bars 72, however, are preferably case hardened steel and thus are more wear resistant than aluminum or steel which has not been hardened.

Figure 6:
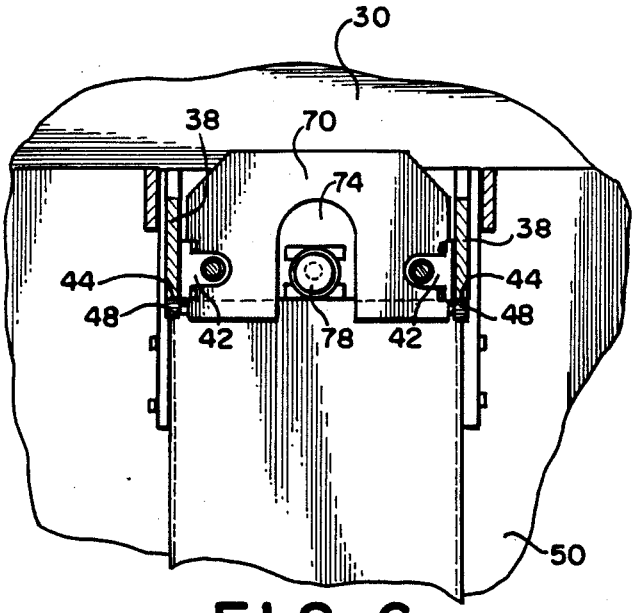
FIG. 6 is a partial section view taken along lines 6—6 in FIG. 2.

A substantial portion of the weight supported on movable platform 50 is preferably supported forward of the longitudinal axes of guide shafts 72. Accordingly, there is a force on the shafts urging them to tilt forwardly on their supports, which wears on the linear bearings 42. It is not recommended that the patient's weight be balanced over the axes of shafts 72, because minimal play due to clearance of shafts 72 in bearings 42 would be noticable and perceived as instability of the overall support. Preferably, in addition to using two spaced bearings 42 for each shafts 72, a pair of supplemental guide wheels 48 are attached to the chassis and roll on the front face of main support legs 38, supporting the overall device against any tilting tendency. Rollers 48 can be seen in FIG. 6 and in FIG. 3, the rollers extending laterally from chassis base plate 68 over the fronts of support legs 38, such that the overall chassis is supported relative to the main support legs 38, at several points, including two points below the linear bearings 42.

Figure 4:
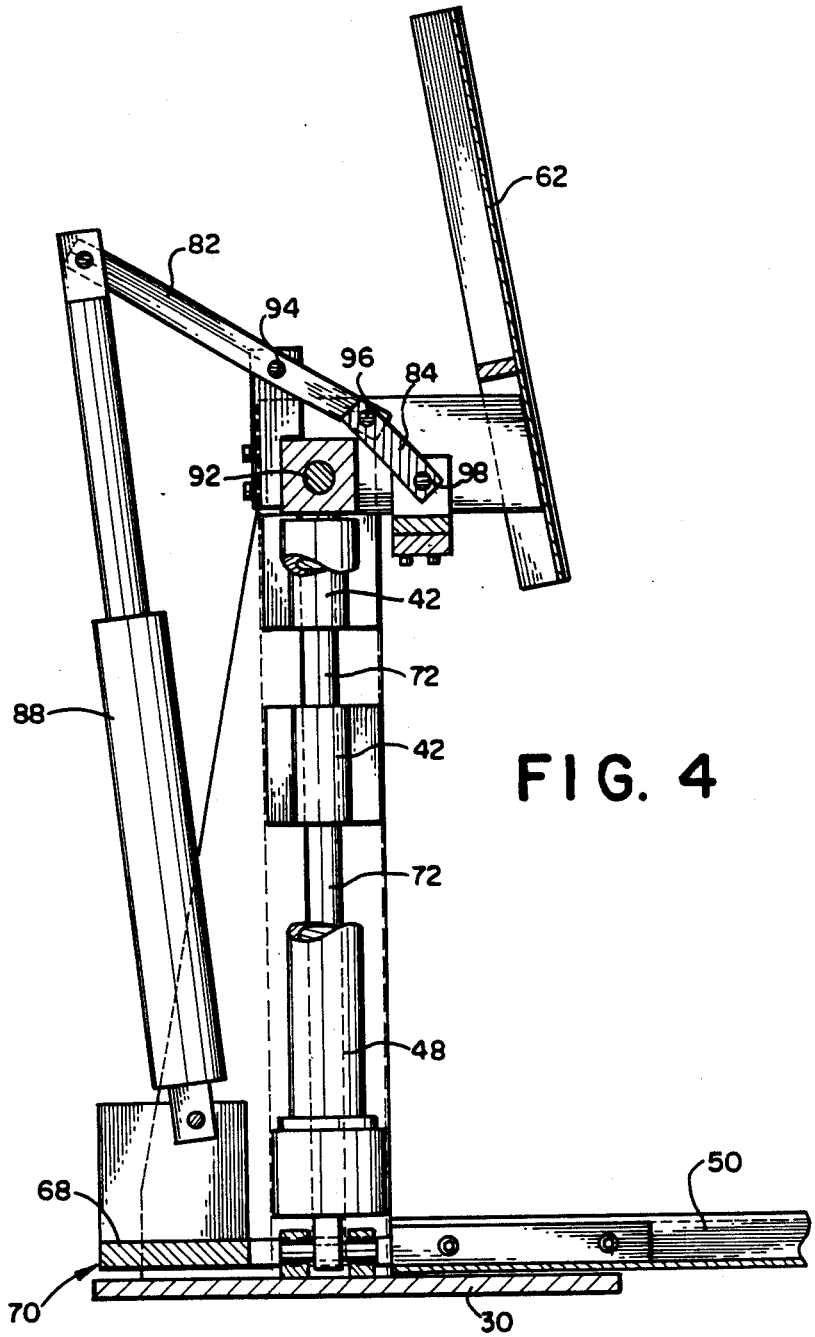
FIG. 4 is a partial section view taken through lines 4—4 in FIG. 2.

In addition to raising and lowering via drive cylinder 78, a second cylinder 88 is provided on the wheelchair support, for accomplishing tilting. Unlike the up/down drive cylinder 78, which was fixed at its lower end directly to base plate 30, the tilt drive cylinder 88, as shown in FIG. 4, is attached to chassis 70 at its lower end, in particular to base plate 68 of movable chassis 70. Cylinder 88 can be the same type cylinder as cylinder 48, but is mounted to tilt the chair-engaging structure by driving a lever arm pivoted around axis 94 at the top of chassis 70. Cylinder 88 thereby causes the movable chair supporting structure to pivot around axis 92, also carried on chassis 70. The movable platform chair engaging structure may include the movable platform 50, the back piece 62, optionally including a head rest 64, means pivotally attaching these parts to the cross member 76 at the top of chassis 70, and the movable side bar 66. These parts are all rotated together around shaft 92, forming a pivot axis at the top crossmember 76 of chassis 70. Shaft 92 likewise can be raised and lowered together with the rest of chassis 70, and when being raised and lowered carries along tilting drive cylinder 88. Therefore, both raising/lowering and forward/rearward tilting movements are accommodated.

Figure 3:
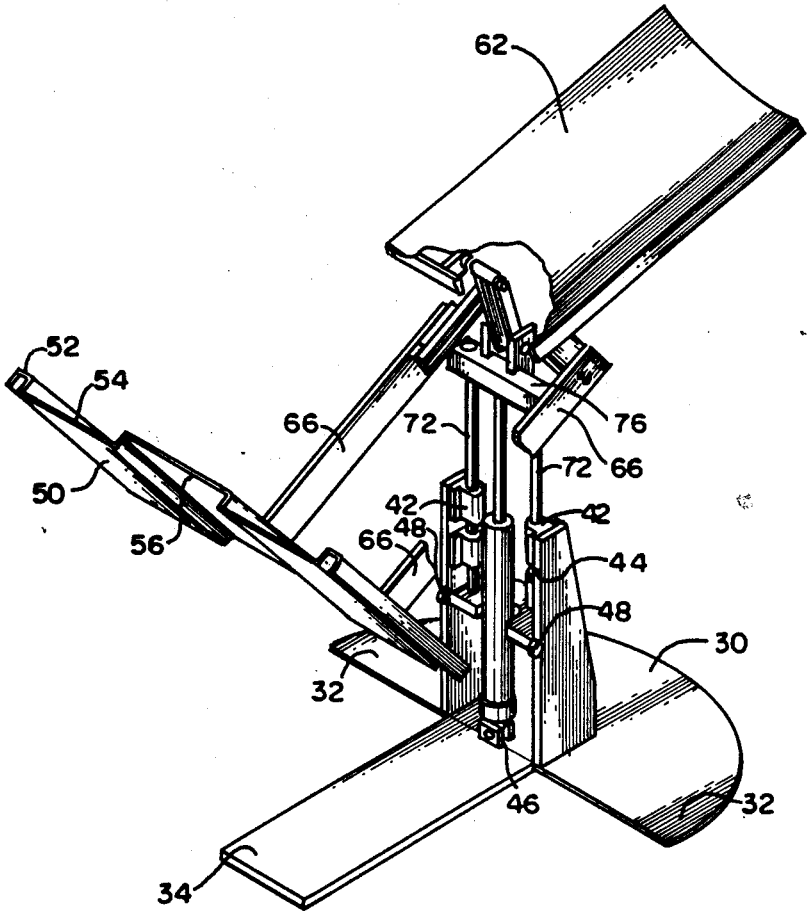
FIG. 3 is an elevation view corresponding to FIG. 1, however, the device is shown at a vertical extension and a tilt.

Backpiece 62 and movable side bar 66, together with movable platform 50, define a large L-shaped receptacle for the wheelchair, against which the wheelchair rests under the force of gravity whenever the movable elements are tilted rearwardly from the upright position around the axis defined by a shaft within cross member 76, as shown in FIG. 3. As a preliminary matter, it is preferable at least slightly to tilt platform 50 and its connected components 66, 62, 64, prior to raising the device using up/down drive cylinder 78. This can be accomplished by routing the power for the up/down drive cylinder through a limit switch mounted on the main support leg(s) 38 or on the rear edge of movable platform 50 or movable side bars 66, which limit switch is closed to enable operation of the up/down cylinder 78 only when side bars 66 are not in such close proximity to main support leg members 38 as to indicate that the wheelchair could roll off platform 50. When platform 50 is first tilted, thereby opening a space for example between platform 50 and legs 38, the limit switch closes and up/down operation in enabled.

Movable platform 50 is a sheet metal platform, approximately one quarter inch thick, having a plurality of right angle bends across its surface forming upwardly and downwardly opening channels. The channels stiffen the platform structure. Edge channels 52 are downwardly-facing channels that safely present a blunt outer edge to the platform, and also substantially stiffen the platform. The central downwardly-opening channel 56 is dimensioned to straddle front tab 34 of stationary base 30. Between these downwardly-opening channels are defined upwardly opening channels 54, for receipt of the wheelchair wheels. The sides of the upwardly opening channels 54, namely the outsides of the downwardly-opening channels, keep the wheelchair from being wheeled-on out of alignment with the platform, or being misaligned thereafter such that any of the wheels might be in danger of extending over the edge of the platform 50 and dropping the patient.

Figure 2:
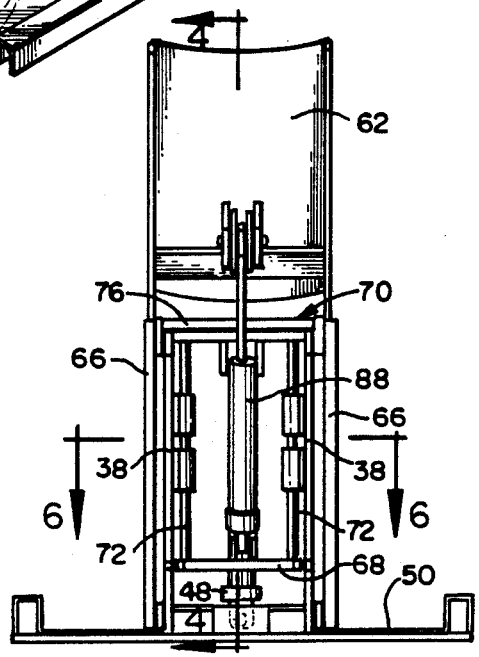
FIG. 2 is a rear elevation view thereof.

The surfaces of upward-opening channels 54 on platform 50 are provided with non-slip surfaces, such as a glued-on rubber or sandpaper grit sheet 58, shown in FIGS. 1 and 2. Sheet 58, which can also be formed by gluing particles directly to the platform 50, keeps the wheelchair from shifting on platform 50, especially laterally, within the span of channels 54.

Referring to FIG. 4, the linkage for tilting the movable wheelchair-supporting elements 50, 66, 62 around shaft 92 includes a plurality of pivotably connected linkage members. A major link 82 pivots around shaft 92, rigidly attached to an upward projection from chassis 70 adjacent cross member 76 and shaft 92. In rotating major link 82 around rotation axis 94, cylinder 88 must be free to tilt forward and backward slightly, as shown in FIG. 4. The overall linkage mechanism preferably includes a second link as well, pivotably connected to the first, the mechanism having a major link 82 and minor link 84, connected at a pivotable connection 96.

Figure 5:
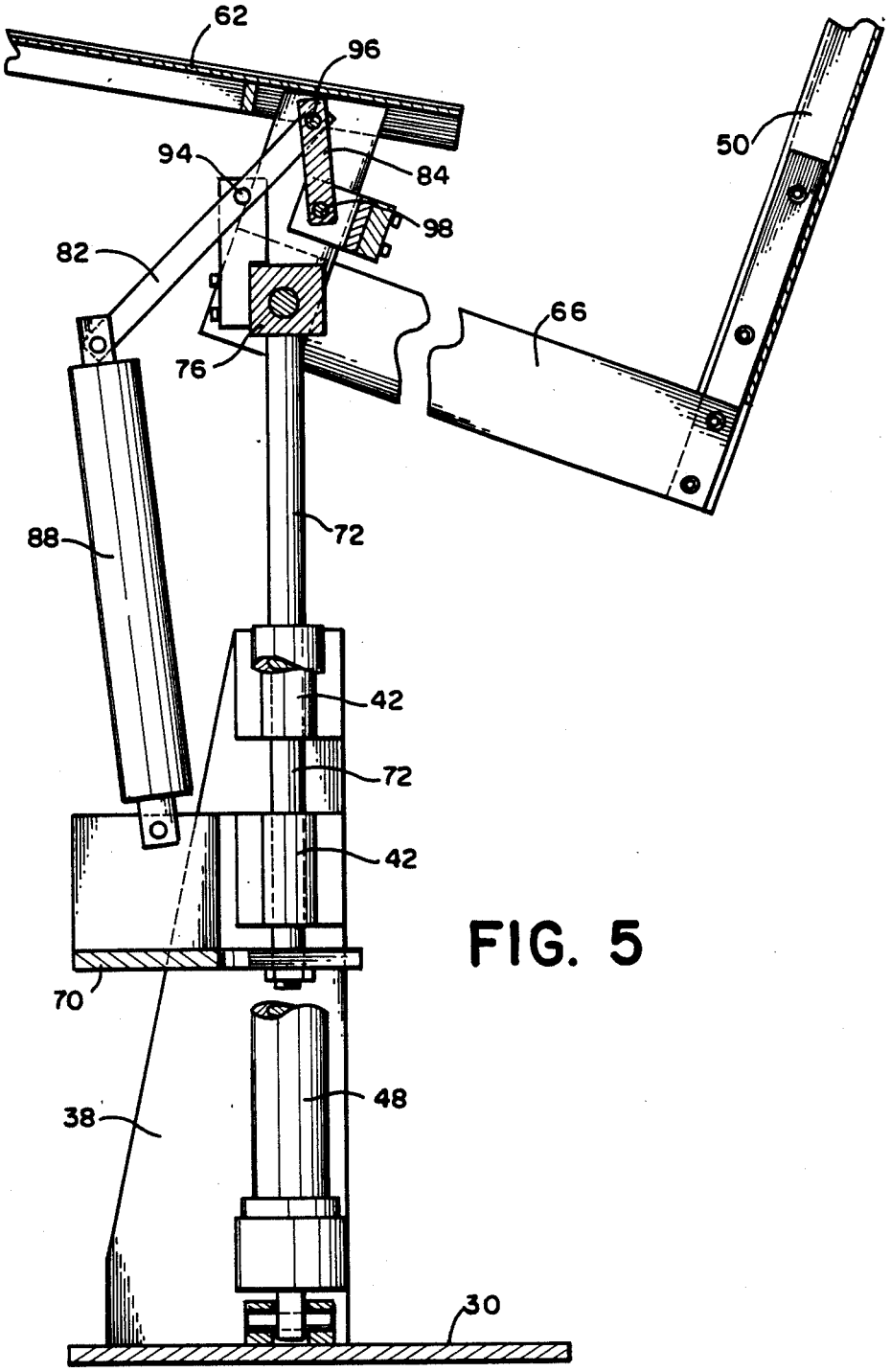
FIG. 5 is a partial section corresponding to FIG. 4, however, the support is shown raised and tilted.

When tilting the chair engaging structures around shaft 92, the effective lever arm defined by major link 82 and minor link 84 varies with the degree of tilt. Pivotable connection 96 is a connection solely between link 82 and minor link 84, i.e., the position of pivot 96 is not fixed in space. Minor link 84 is connected at pivot point 98 to the wheelchair-supporting movable elements including backpiece 62, side bars 66 and movable base 50. In the upright position as shown in FIG. 4, major link 82 and minor link 84 are substantially co-linear. Therefore in this position, a maximum total length is defined between pivot point 94, attaching the major link to the chassis 70, and pivot point 98 attaching the linkage mechanism to the tiltable wheelchair supporting structure. This gives minimum mechanical advantage to cylinder 88 when the chair is upright, but also permits the fastest tilting motion because of the lever arm lengths between the cylinder and pivot 94 on the one hand, and between pivot 94 and pivot 98 on the other hand. In the preferred embodiment, the tilting axis 92 is not under the center of gravity of the patient and chair. Gravity, of course, thus tends to oppose rotating platform 50 and the like around shaft 92, as this amounts to lifting a weight. In the position shown in FIG. 4, cylinder 88 has substantially a one to one power transferring relationship because the lengths of the linkage segments on either side of pivot point 94 are substantially equal. This changes as the cylinder 88 shortens, causing the chair support structure to rotate around shaft 92. As shown in FIG. 5, shortening cylinder 88 causes the minor link 84 of the linkage mechanism to become more vertical, whereupon the effective distance between pivot points 94 and 98 is much shorter. Therefore, there is a much larger length of lever between pivot 94 and cylinder 88 on major link 82 than there is between pivot 94 and 98, which includes the major and minor links, providing added mechanical advantage. The major and minor links are now inclined relative to one another due to the tilt and gravity tending to bring the chair supports structures including platform 50, side bar 66 and backpiece 62 into their lower-most position. In the configuration shown in FIG. 5, the mechanical advantage ratio or gear reduction across the range of tilt varies from 1:1 when upright to about 1.4:1 at maximum tilt. The ratio can be on the order of from about 1.0 to 1.0 up to 2.0 to 1.0, if desired.

In tilting the device according to the invention, a substantially greater amount of tilt is achieved per unit of displacement of drive cylinder 88 in the upright position than in the tilted position. The drive cylinder slows down slightly due to changing load conditions at decreased mechanical advantage, but the reduction in speed is small compared to the effect of changes in the effective lever arm of the tilt mechanism. Accordingly, when starting from upright; the user will be more quickly moved (tilted), and when nearing the point of full tilt, the rate of motion (tilting) is about half the maximum. As a result, the adjustability of the tilt position is much finer while the tilt is maximum and movement is slower. This is particularly apt for a support to receive wheelchairs, especially to avoid the wobbling and lurching which occurs in starting and stopping the tilt mechanism near the point of maximum displacement, when a substantial weight has been rotated around shaft 92 and the patient and chair define a center of gravity spaced forward from shaft 92.

In connection with a dentist chair for a standard type wheelchair, the vertical span driven up/down cylinder 78 is preferably about a foot (30 cm). This span is defined either by the span of the cylinder or by the distance between base plate 68 of chassis 70 and the lowermost linear bearing 42 (see, e.g., FIG. 4). As a matter of optimum design, it is preferred that the spacing between the two linear bearings 42 be about one third of the extent of maximum vertical travel. At typical load, either of the cylinders will be displaced at a rate of about one half inch (1.25 cm) per second, and at full deflection the platform will be tilted about 80°. The limit switches noted hereinabove preferably require a minimal tilt to ensure safe reception of the wheelchair, for example of about 5°, before the up/down drive cylinder will be operable.

Platform 50 is preferably made of bent aluminum, to conserve weight. A better structural interconnection between side legs 66 and base member 50 is provided by bolting platform 50 to side legs 66 using steel bars (shown in FIG. 4).

The driving parts of the invention are located substantially between the main support legs 38, and therefore these parts are clear of the structure of the wheelchair, all points forward of the front surfaces 44 of main support legs 38 being clear. Self-powered electric wheelchairs frequently include large battery packs, carrying baskets and/or motor assemblies that extend to the rear from the the rear wheel axles. Accordingly as shown in FIG. 4, the movable portions 50, 66, 62 preferably are attached together with a further structural element between back 62 and the area of cross member 92, such that the overall movable part defines a "C" shape, leaving a certain span to the rear of backpiece 62, where a wheelchair battery pack or the like can reside.

Movable platform 50 is designed to support wheelchairs of various types and sizes. The minimum and maximum lateral wheel spacings are defined by the width of upward-facing channels 54, these channels preferably being provided with glued-on grit or sandpaper 58, providing good traction on platform 50 for the wheelchair wheels. Traction is important both for moving the chair onto and off of the platform, and also preventing slippage laterally. Adequate spacing is provided for swiveling the smaller front wheels of the wheelchair, free of contact with the channel walls. Reinforcing plates are preferably provided under the upward facing channels 54, to better reinforce this portion of the platform, which carries directly the wheels of the wheelchair.

Drive cylinders 78, 88 can be pneumatic (e.g., foot pumped) hydraulic, or electrical, in the latter case having a helical screw or rack and pinion. Preferably, the cylinders are electrically-driven variable voltage direct current devices, for example powered at 24 or 28 volts DC at full power, and include viscous damping means. A control circuit is preferably operable even upon the user suddenly switching to full power to provide voltage increasing in to the required power level a ramp. A ramped power transition (up or down) avoids jerks which occur in starting and stopping if full power is simply turned on and off. Wobbling and jerking can be a problem, especially at full-height and full tilting extension. The cylinders can also be alternating current devices, or pulsed DC devices such as stepping motors. It is also possible to achieve adequate stability without a ramping control, e.g., based upon relay closures, provided the structural connections of the parts are very tight and without play.

Damping mechanisms are preferably employed in addition to or in lieu of other stability improvement means such as a ramping power control. Gas springs and damping cylinders can be used to dampen oscillations and provide better stability. A first damping apparatus in the form of a gas spring can be connected in parallel with drive cylinder 78, urging the chassis upwards and damping up/down oscillation. A second damping apparatus, for example an oil-filled cylinder with a perforated piston, is connected in parallel with cylinder 88. These damping mechanisms can be packaged directly within the housings of drive cylinders 78, 88.

The electronics drive and control package preferably includes a comprehensive logic control including limit switches and/or relays that automate height extension and tilting operations to some extent. It is presently preferred, as noted above, to require at least a minimal tilt (e.g., 5°) to secure the wheelchair before the vertical extension mechanism is enabled to operate. This minimum tilt can be sensed, for example, by a limit switch sensing the spacing between main support legs 38 and movable side bars 66. As a further one-switch control, means preferably are provided for returning the device to the down position using a single switch selection. This can include simply a latching relay allowing a single push button control to initiate operation in the retraction direction until limit switches for tilt and vertical extension indicate that the movable parts have reached the "home" position, namely fully upright and at zero vertical displacement.

It is also possible to arrange the chair to include a temporary battery power supply sufficient to enable the extension and tilt mechanisms to be returned to home position in the event of power failure. It is most difficult to remove the non-ambulatory patient from the device when in the upright and tilted position. Therefore, battery power in a rechargeable unit adequate to operate the device for at least a few minutes is recommended.

Figure 7:
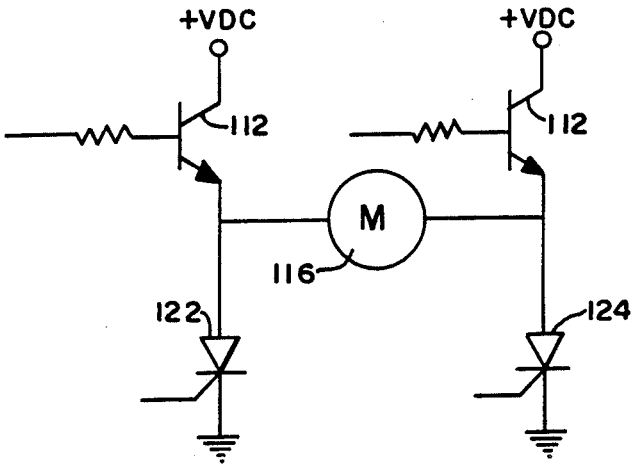
FIG. 7 is a schematic diagram showing portions of a reversible motor control.

A schematic diagram of a polarity-reversing ramping control power supply is shown in FIG. 7. A motor 116 is connected to the positive DC voltage power supply through a pair of power transistors 112. By coordinating the turn-on of either of the power transistors 112 with turning on one of the two silicon controlled rectifiers (SCRs) 122, 124, current can be routed through motor 116 in one direction or the other, thereby causing the drive cylinder, i.e., either the up/down drive cylinder 78 or the tilt drive cylinder 88 to extend or retract, respectively. The voltage level applied to motor 116 in the drive cylinder can also be controlled by varying the voltage supplied through a resistor to the base of the respective power transistor 112, the transistor being operated during ramping in its transition region rather than at saturation. Accordingly, by slowly increasing the voltage on the base of one of the transistors 112, while applying a voltage to the gate of the SCR located on the opposite side of motor 116 from the respective transistor, a ramping voltage is provided to smoothly increase or decrease the voltage across the drive cylinder when starting or stopping. An increasing voltage to be applied to the transistors bases can be produced, for example by a simple resistor/capacitor network with a capacitor being charged through a resistor.

The control electronics for the device are preferably located in a small enclosure which can be located on either side of the chair as desired, in order to accommodate left handed and right handed dentists or the like. Typically, the dentist stands on the patient's right side and a lamp, water supply column or the like are located on the patient's left side. A foot switch device preferably includes switches at least for "up", "down", "tilt up", "tilt down" and "home". The controls can be reversed to either side of the chair, if required.

Preferably, the drive cylinders, chassis and other movable parts which might be pinch hazards are covered by a protective cowling of plastic, a flexible bellows material or the like. This cover also insulates against escape of sound from the drive cylinders during operation.

It is also possible to employ extendable cylinders of a hydraulic or pneumatic type rather than the electrically actuated type. However, electric drive cylinders are preferred because they are adequately smooth and quiet in operation and no unsealed oil pump or oil reservoir or other leak-prone structure is involved. Notwithstanding the use of the electric actuation means, the variable linkage tilt mechanism provides a very smooth mechanical operation characterized by making electrical actuators motion near the upright orientation of the support structure and greater adjustability near the maximum tilt, which is quite apt for the particular application. Preferably, at least main cross member 76, and preferably also the pivotable connections at fulcrum pivot 94, intermediate pivot 96 and connection pivot 98, are provided with anti-friction bushings for even smoother operation.

A number of variations are also possible according to the invention. A similar apparatus can be adapted for use by hairdressers and the like by shortening the backpiece 62 to allow better access to the back of the head of the customer (c.f., patient).

A footrest 86 is preferably arranged to raise out of platform 50 for use by patients whose wheelchairs do not have conveniently-positioned footrests. Footrest 86 is shown in FIGS. 1 and 2. Without a footrest of some kind, the patient's legs may drop backward into the wheelchair frame area. The footrest is preferably a simple pivoted panel with means pivoted to said panel for fixing the footrest in an extended position when deployed.

Arm restraints are also useful in the case of patients without good muscle control. Appropriate arm restraints may be bag-like receptacles receiving the patient's forearms, attachable by loops to the wheelchair or wheelchair support.

A support structure for the wheelchair characterized by means engaging directly on structural members of the wheelchair rather than a platform for supporting the chair from underneath is also possible. In that event, clamp extensions in the area of side members 66 are preferably provided, including jaw means operative to grasp and thus clamp directly onto the tubular members or other structures adjacent the back portion of the wheelchair. Other variations are also possible and will now be apparent to persons skilled in the art.

The invention as disclosed is an apparatus for controllably positioning a wheelchair 20, comprising a stationary base 30, a vertical extension mechanism 78 connected by one end to the base 30, and means 112, 122, 124 for operating the vertical extension mechanism 78 to extend and to retract. A chassis 70 is connected to a second end of the vertical extension mechanism, whereby extension of the vertical extension mechanism raises the chassis 70 relative to the base 30. A wheelchair-supporting and/or engaging mechanism 50 such as a platform is supported at least partly by the chassis 70, the platform receiving and supporting the wheelchair 20. An angular extension mechanism 88 is disposed on the chassis 70, the angular extension mechanism 88 being operable to rotate the platform or other wheelchair support 50 around an axis 92 adjacent the chassis 70. The vertical extension mechanism 78 and the angular extension mechanism 88 are preferably controllable independently of one another.

The vertical extension mechanism can be a length-extendable cylinder 78 connected at one end to the base 30 and at an opposite end to the chassis 70, the device further comprising linear guide means 42, 48 on the base for guiding vertical displacement of the chassis on the base.

At least one main support leg 38 can be provided on the base, the vertical guide means including a guide shaft 72 and a bushing 42, one of the guide shaft and the bushing being mounted on the main support leg 38 and the other of the guide shaft and the bushing being mounted on the chassis 70. The bushing 42 can be a linear bushing mounted on the main support leg 38 and the chassis 70 can include a guide shaft 72 slidably received in the bushing.

Preferably the vertical guide means includes at least one roller 48 mounted on the chassis 70, the roller 48 movably bearing on the main support leg 38. The vertical guide means can comprise a pair of main support legs 38 on the base 30, each of the main legs 38 having a bushing 42 and the chassis having a pair of guide shafts slidable in said bushings, the main support legs 38 being positioned laterally on the base.

The chassis 70 preferably includes elements 68, 76 connected to the shaft 72 above and below said bushing 42, the bushing defining a maximum vertical extension reached when the elements 68 connected to the shaft below said bushing abut the bushing. The chassis can have an upper cross bar disposed above the bushing and a lower cross bar or chassis base member disposed below the bushing, the support means including a wheelchair engaging structure 50, 66, 62 such as a platform 50 rigidly attached to a support bar 66 and the support bar 66 being pivotably mounted to the chassis 70 on a horizontal axis 92 adjacent the upper cross bar 76. The platform 50 can be a plate having parallel channels 54 on an upper surface thereof for receiving wheels of the wheelchair, the support bar 66 being arranged perpendicular to the platform 50 and attached to the platform at one end of the support bar 66, the support bar and the platform defining an L-shaped configuration.

A lever 82 can be provided, extending eccentrically from the support bar adjacent the axis 92, the angular extension mechanism including a length extension cylinder 88, controllably extendable between the lower cross bar 68 of the chassis 70 and a distal end of the lever. The platform 50 on the chassis can define a movable wheelchair support structure, the wheelchair support structure being pivotable around an axis 92 defined by the cross member 76 adjacent an upper end of the chassis 70, the length extension mechanism including a major link 82 pivotable around an axis 92 spaced from the axis of the cross member, and a minor link pivotably attached to the wheelchair support mechanism at a point angularly spaced around the axis of the cross bar 76, whereby a lever arm defined by the angular extension mechanism varies with the current angular orientation of the wheelchair support structure 50, 66, 62 relative to the chassis 70. The pivot axis 94 of the major link 84 and the pivotable connection between the minor link and the wheelchair support structure are preferably spaced about 90° around said cross member 76.

The invention can also be characterized as an apparatus for controllably positioning a wheelchair 20, comprising a stationary base 30 having a pair of main support legs 38 extending vertically from the base, the main support legs having linear guide means 42 disposed thereon, a chassis 70 being carried on the main support legs 38 by the linear guide means 42, a length-extendable cylinder being disposed between the base 30 and the chassis 70, and being controllably operable to raise the chassis 70 relative to the base 30. A wheelchair support structure 50, 66, 62 is disposed to rotate around an axis 92 defined by a horizontal cross member 76 of the chassis 70, the wheelchair support structure 50, 66, 62 being rotatable about said cross member 76 independently of a vertical position of the chassis 70, and, an angular extension mechanism 88 being disposed on the chassis 70 and connected to the wheelchair support structure 50, 66, 62, the angular extension mechanism having a length-adjustable cylinder 88 connected to the wheelchair support structure through a linkage arm 82 pivotably mounted on the chassis 70.

The linkage can include a major link 82 and a minor link 84, the major link 84 being pivotable on the chassis and the minor link being freely pivotable on a free end 96 of the major link 82, the minor link 84 being attached to the wheelchair support structure 50, 66, 62 at one end 98 and to the major link 82 at the opposite end 96, points of attachment between the minor link 84 and the wheelchair support structure 50, 66, 62 on the one hand, and between the major link 82 and the chassis 70 on the other hand, being angularly spaced around the cross member 76, whereby a moment arm of the angular support mechanism as applied to the wheelchair supports structure varies with angular position of the wheelchair support structure relative to the base.

What is claimed:

1. An apparatus for controllably positioning a wheelchair, comprising:

a base;

a vertical extension mechanism connected by one end to said base, and means for operating the vertical extension mechanism to extend and to retract;

a chassis connected to a second end of said vertical extension mechanism;

support means for engaging and supporting a wheelchair, the support means being carried at least partly on the chassis, the support means receiving and supporting the wheelchair during extension and retraction;

an angular extension mechanism disposed on the chassis, the angular extension mechanism being operable to rotate the support means around an axis adjacent the chassis; and, linear vertical guide means on the base for guiding vertical displacement of the chassis on the base, the vertical guide means including a guide shaft and a bushing, one of the guide shaft and the bushing being mounted on a main support leg on the base and the other of the guide shaft and the bushing being mounted on the chassis, the vertical guide means also including at least one roller mounted on the chassis, the roller movably bearing on the main support leg.

2. The apparatus of claim 1, wherein the bushing is a linear bushing mounted on the main support leg and the chassis includes a guide shaft slidably received in the bushing.

3. The apparatus of claim 1, wherein the vertical guide means comprises a pair of main support legs on the base, each of the main legs having a bushing and the chassis having a pair of guide shafts slidable in said bushings, the main support legs being positioned laterally on the base.

4. The apparatus of claim 3, wherein the chassis has an upper crossbar disposed above the bushing and a lower crossbar disposed below the bushing, the support means including a platform rigidly attached to a support bar and the support bar being pivotably mounted to the chassis on a horizontal axis adjacent the upper crossbar.

5. The apparatus of claim 4, wherein the platform is a plate having parallel channels on an upper surface thereof for receiving wheels of the wheelchair, the support bar being arranged perpendicular to the plate and attached to the plate at one end of the support bar, the support bar and the plate defining an L-shaped configuration.

6. The apparatus of claim 5, wherein said upper surface is provided with friction-improving grit.

7. The apparatus of claim 5, further comprising a lever extending eccentrically from the support bar adjacent the axis, the angular extension mechanism including a length extension cylinder controllably extendable between the lower crossbar of the chassis and a distal end of the lever.

8. The apparatus of claim 1, wherein the chassis includes elements connected to the guide shaft above and below said bushing, the bushing defining a maximum vertical extension reached when the elements connected to the shaft below said bushing abut the bushing.

9. An apparatus for controllably positioning a wheelchair, comprising:

a stationary base;

a vertical extension mechanism connected by one end to said base, and means for operating the vertical extension mechanism to extend and to retract;

a chassis connected to a second end of said vertical extension mechanism, whereby extension of the vertical extension mechanism raises the chassis relative to the base;

support means for engaging and supporting a wheelchair, the support means being carried at least partly on the chassis, the support means receiving and supporting the wheelchair during extension and retraction;

an angular extension mechanism disposed on the chassis, the angular extension mechanism being operable to rotate the support means around an axis adjacent the chassis, the support means including a platform rigidly attached to a support bar, to define an L-shaped configuration for receiving the wheelchair, the angular extension mechanism including a lever extending eccentrically from the support bar adjacent the axis, the angular extension mechanism including a length extension cylinder controllably extendable between the chassis and an end of the lever, the platform and the chassis defining a movable wheelchair support structure, the wheelchair support structure being pivotable around an axis adjacent an upper end of the chassis, the length extension mechanism including a major link pivotable around an axis spaced from the axis adjacent said upper end of the chassis, and a minor link pivotably attached to the wheelchair support mechanism at a point angularly spaced around the axis adjacent said upper end of the chassis, whereby a lever arm defined by the angular extension mechanism varies with the angular orientation of the wheelchair support structure and the chassis.

10. The apparatus of claim 9, wherein the pivot axis of the major link and the pivotable connection between the minor link and the wheelchair support structure are angularly spaced about 90° around said cross member.

11. The apparatus of claim 10, wherein at least one of the vertical extension mechanism and the angular extension mechanism include a damping apparatus operable to damp oscillation of the wheelchair support structure.

12. An apparatus for controllably positioning a wheelchair, comprising:

a stationary base having a pair of main support legs extending vertically from said base, the main support legs having linear guide means disposed thereon;

a chassis carried on the main support legs by said linear guide means, a length-extendable cylinder being disposed between said base and said chassis, and being controllably operable to raise the chassis relative to the base;

a wheelchair support structure rotatably disposed on the chassis around an axis defined by a horizontal cross member of the chassis, the wheelchair support structure being rotatable about said cross member independently of a vertical position of the chassis; and, an angular extension mechanism disposed on the chassis and connected to the wheelchair support structure, the angular extension mechanism having a length-adjustable cylinder connected to the wheelchair support structure through a linkage arm pivotably mounted on the chassis, the linkage including a major link and a minor link, the major link being pivotable on the chassis and the minor link being freely pivotable on the free end of the major link attached to the wheelchair support structure at one end and to the major link at the opposite end, points of attachment between the minor link and the wheelchair structure on the one hand, and between the major link and the chassis on the other hand, being angularly spaced around the cross member, whereby a moment arm of the angular support mechanism as applied to the wheelchair support structure varies with angular position of the wheelchair support structure relative to the base.

13. The apparatus of claim 12, further comprising at least one damping apparatus connected to the wheelchair support structure and operable to damp oscillation thereof.

14. The apparatus of claim 12, wherein at least one of the length-extendable cylinder and the angular extension mechanism are electrically driven and further comprising a ramping power control connected thereto.

* * * * *